US007376568B2

(12) United States Patent
Anekoji

(10) Patent No.: US 7,376,568 B2
(45) Date of Patent: May 20, 2008

(54) VOICE SIGNAL PROCESSOR

(75) Inventor: Fumio Anekoji, Ninomiya-machi (JP)

(73) Assignee: Freescale Semiconductor, Inc., Austin, TX (US)

( * ) Notice: Subject to any disclaimer, the term of this patent is extended or adjusted under 35 U.S.C. 154(b) by 82 days.

(21) Appl. No.: 11/315,733

(22) Filed: Dec. 22, 2005

(65) Prior Publication Data

US 2006/0149559 A1 Jul. 6, 2006

(30) Foreign Application Priority Data

Jan. 5, 2005 (JP) ..... 2005-000936

(51) Int. Cl.
*G10L 21/00* (2006.01)

(52) U.S. Cl. ..... 704/500; 704/200

(58) Field of Classification Search ..... 704/212, 704/230

See application file for complete search history.

(56) References Cited

U.S. PATENT DOCUMENTS 5,809,133 A * 9/1998 Bartkowiak et al. ..... 379/386
6,201,834 B1 * 3/2001 Zhu ..... 375/240.27
6,393,000 B1 * 5/2002 Feldman ..... 370/316
6,418,405 B1 * 7/2002 Satyamurti et al. ..... 704/206
6,882,634 B2 4/2005 Bagchi et al.
2003/0023429 A1 1/2003 Claesson et al.
2003/0195745 A1 10/2003 Zinser, Jr. et al.
2004/0030546 A1 2/2004 Sato

OTHER PUBLICATIONS

Sagara, Iwao, Introduction to AD/DA Conversion Circuits, Nikkan Kogyosha Nov. 28, 1991, pp. 234-244.

* cited by examiner

*Primary Examiner*—Abul K Azad
(74) *Attorney, Agent, or Firm*—Charles Bergere

(57) ABSTRACT

A voice processor performing logarithm compression and decompression enabling various signal processing functions to be efficiently added. When there is a μ Law compression input, an approximate logarithm conversion process is performed. The processor performs bit inversion on the μ Law compression value and sets MSB to "0" to obtain an approximate μ log value. The approximate μ log value is then subjected to various basic calculations. With respect to the approximate μ log value, multiplication of linear values is performed through addition, and division is performed through subtraction. Further, the squaring of a linear value is performed by shifting 1 bit toward the right, and square root calculation of a linear value is performed by shifting 1 bit to the left. Also, a twofold of the linear value is calculated by adding "16". The processor outputs the result to obtaining a μ Law compression output.

5 Claims, 6 Drawing Sheets

VOICE SIGNAL PROCESSOR

BACKGROUND OF THE INVENTION

The present invention relates to a voice signal processor provided with a function for converting a logarithm-compressed CODEC signal to a linear signal and for converting a linear signal to a logarithm-compressed signal, and more particularly, to voice signal processing that performs calculations on such signals.

A typical voice signal has a relatively wide dynamic range and requires many levels for quantization. To reduce the number of the quantization levels using a non-linear quantization process, a logarithm-compressed conversion code may be employed. In logarithm-compressed conversion, digital curve approximate compression is used for digitizing a voice signal. In other words, a sampled signal is subjected to logarithm compression, and then uniform quantization is performed. To demodulate the signal, the signal is subjected to decompression having transmission characteristics opposite to those of compression.

The G.711 standard defined by the ITU is a compression algorithm most commonly used for communication networks throughout the world. In the G.711 standard, two logarithm quantization laws (A Law and μ Law) are used in various types of networks for pulse code modulation (PCM). More specifically, a linear PCM sample having 13 bits in the A Law or 14 bits in the μ Law is compressed using 8 bit logarithm characteristics (see, for example, pp. 234 to 244 of "Introduction to AD/DA Conversion Circuits" by Iwao Sagara, NIKKAN KOGYOSHA, published on Nov. 28, 1991).

In the μ Law, the amplitude of an entire analog signal, which is a voice signal, is equally divided into sixteen rough step 15 segments. Eight bits are employed with one bit functioning as a sign bit representing polarity (MSB) and three bits functioning as segment bits representing corresponding curves. Next, each of the curves is divided linearly into sixteen equal sections and then allocated as a 4-bit step bit. As a result, one word corresponds to 8 bits. In the A Law, the analog signal is equally divided into fourteen 13 segments including positive and negative areas and then each of the segments is divided into sixteen segments. Currently, the μ Law is employed in Japan and America and the A Law is employed mainly in Europe for digital telephones.

In the above-described voice signal processing, multiplication and accumulation calculation is necessary for processing a linear signal (using filters such as an infinite impulse response filter (IIR) and a finite impulse response filter (FIR)). However, when controlling the processing of a linear signal or a non-linear signal (using an adaptive filter, an auto gain controller (AGC), a level limiter, or a level comparer), multiplication or division is necessary for calculating power, signal ratio, and gain. Further, there are functions that require logarithm characteristics. These calculations require a relatively large number of commands, complicated calculations, special function blocks, and processors that operate at high speeds. Thus, in many cases, a signal processor includes a multiply and accumulate unit (MAC) for efficiently processing a linear signal. However, when a division must be performed multiple commands must be combined.

Furthermore, through logarithm conversion, multiplication and division may be converted to addition and subtraction to reduce the number of necessary calculations. However, for this purpose, a logarithm conversion mechanism (a specific calculation mechanism for a table reference method) becomes necessary. That is, additional memory and additional commands become necessary.

SUMMARY OF THE INVENTION

Accordingly, it is an object of the present invention to provide a voice processor for performing logarithm compression or decompression that enables various signal processing functions to be added.

One aspect of the present invention is a voice signal processor including a signal conversion means performing conversion between at least a logarithm compressed CODEC signal and a linear signal. An additional signal processing means extracts the CODEC signal in a logarithm compressed state before the CODEC signal is input to the signal conversion means, processing the CODEC signal, and feeds back a signal processing result to a signal output from the signal conversion means.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
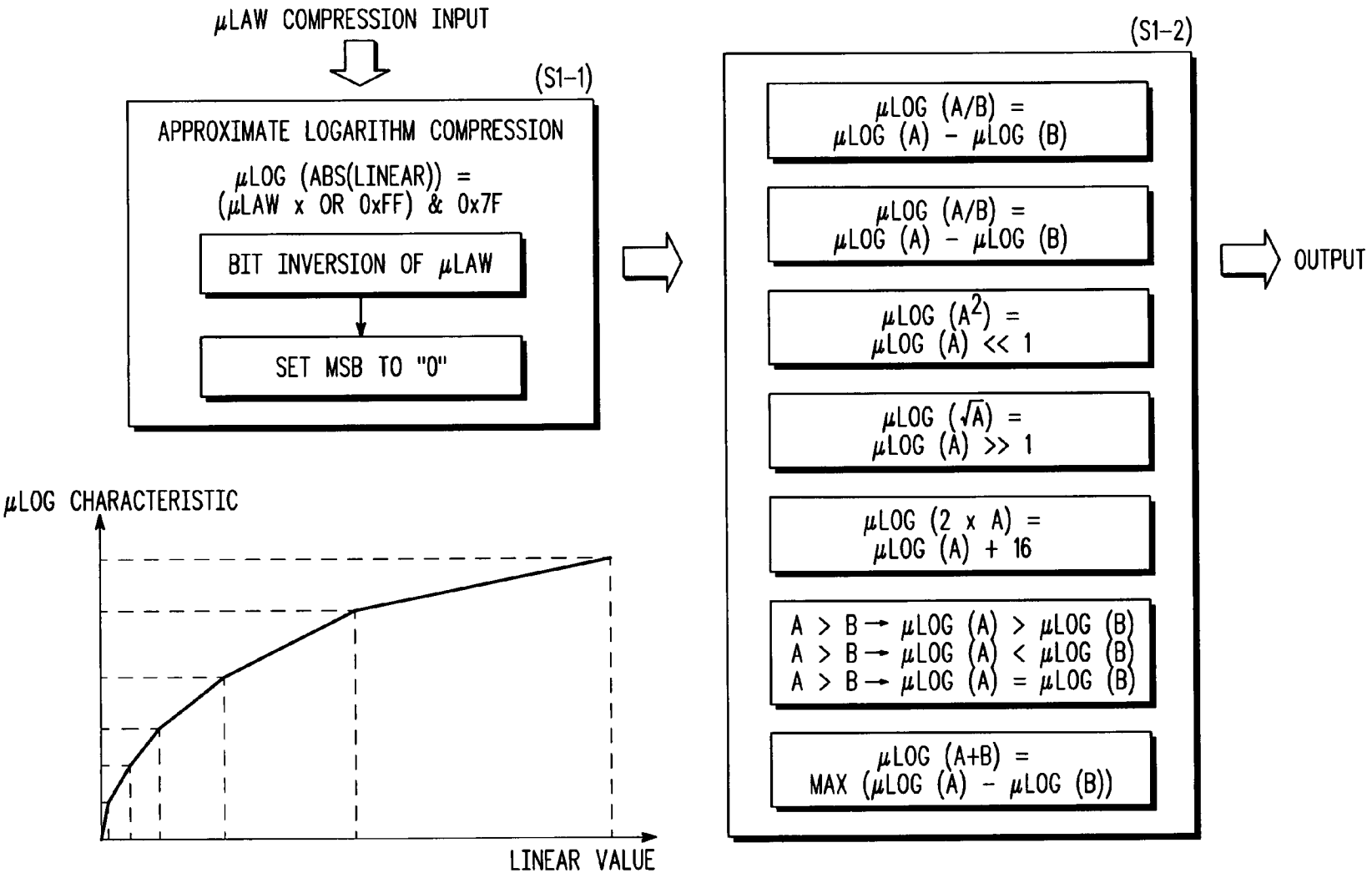
FIG. 1 is a diagram showing the basic concept of the present invention.

A preferred embodiment of the present invention will now be described with reference to FIG. 1. The basic function for obtaining a μ Law compressed input, performing additional signal processing, and acquiring a pseudo logarithm value will be described. More specifically, when there is a μ Law compressed input, an approximate logarithm compression process is performed (step S1-1). In the approximate logarithm compression process, a μ Law compression value for an absolute value of a linear value (abs(Linear)) is obtained. An approximate μ log value is then calculated as an approximate logarithm value.

$$\mu\ \log(\mathrm{abs}(\mathrm{Linear}))=(\mu\mathrm{Law}\ \mathrm{xor}\ 0\mathrm{xff})\&0\mathrm{x}7\mathrm{f}$$

This process is executed by bit-inverting the μ Law compression value and then setting MSB to "0". This obtains μ log characteristics as a function of the value Linear, which is indicated in the graph.

A basic calculation method of the approximate μ log value (step S1-2) that has been converted in this manner and the characteristics of the value will now be described. The approximate μ log value is a logarithm. Thus, the multiplication of linear values is performed as an addition that obtains a sum, and the division of linear values is performed as subtraction that obtains a difference. Further, the squaring of a linear value is performed by shifting one bit to the right, and square-rooting of a linear value is performed by shifting one bit to the left. Also, a twofold value of the linear value is calculated by adding "16".

Since an approximate μ log value is represented by a monotonically increasing function, the ordinal relationship of the values is maintained. Further, addition of linear values is approximated by computing a maximum value.

Then, the result is output to obtain a pseudo logarithm value.

An apparatus using the above-described approximate logarithm conversion and basic calculation in combination will now be described.

First Embodiment

Figure 2:
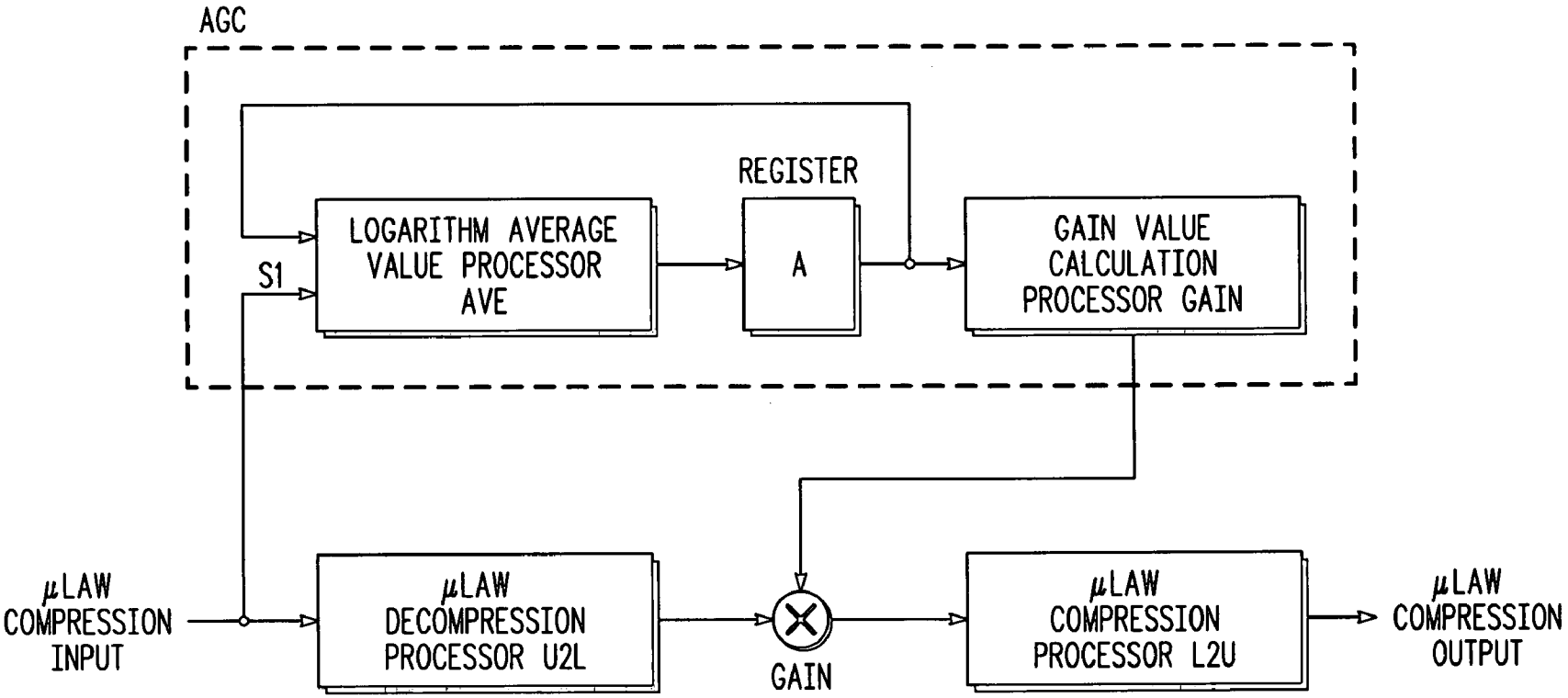
FIG. 2 is a block diagram showing an AGC according to a first embodiment of the present invention.

An auto gain controller AGC will now be described with reference to FIGS. 2 to 4. The auto gain controller AGC is used in a vocal device including a μ Law decompression processor U2L and a μ Law compression processor L2U, each of which functions as a signal conversion means. While using the μ Law decompression processor U2L and the μ Law compression processor L2U, the auto gain controller AGC controls the gain in a manner that an output level is always a fixed value LEV. More specifically, the auto gain controller AGC obtains a moving average of an input signal with a moving average function. The gain is obtained from the equation shown below.

$$\text{Gain}=LEV/\text{Moving Average}$$

A logarithm average value processor AVE extracts a signal S1 input to the μ Law decompression processor U2L. The signal S1 is a μ Law compressed CODEC signal.

The auto gain controller AGC includes a logarithm average value processor AVE, a register, and a gain calculation processor GAIN.

Figure 3:
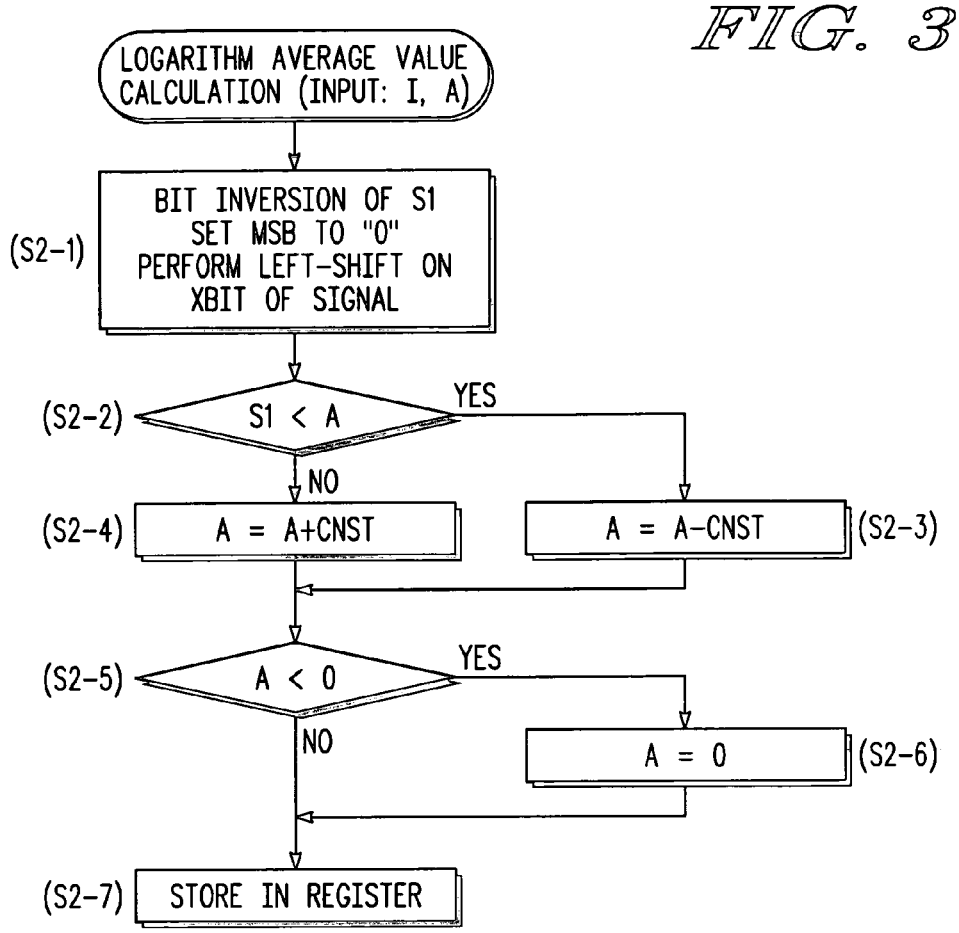
FIG. 3 is a flowchart showing a process performed in the first embodiment.

The logarithm average value processor AVE executes the logarithm average calculation process, which is shown in FIG. 3. In this process, the logarithm average value processor AVE performs an approximate logarithm conversion process (step S2-1). More specifically, the obtained signal S1 is subjected to bit inversion and a most significant bit MSB of the signal S1 is set to "0". In this manner, an approximate μ log value is calculated. Further, in this step, the scale is enlarged using a scaling factor X. That is, an X bit is shifted to the left for signal S1.

Subsequently, the logarithm average value processor AVE reads a logarithm average value A from the register, which serves as logarithm average storage means, and compares the logarithm average value A with the signal S1 (step S2-2). If the logarithm average value A is greater than the signal S1 (YES in step S2-2), a constant CNST is subtracted from the logarithm average value A to set a new logarithm average value A (step S2-3). If the signal S1 is greater than or equal to the logarithm average value A (NO in step S2-2), the constant CNST is added to the logarithm average value A to generate a new logarithm average value A (step S2-4).

The logarithm average value processor AVE then compares the logarithm average value A with "0" (step S2-5). If the logarithm average value A is negative (YES in step S2-5), the logarithm average value A is set to "0" (step S2-6). The logarithm average value A is then recorded to the register (step S2-7). If the logarithm average value A is positive (NO in step S2-5), the logarithm average value A is recorded to the register (step S2-7).

Figure 4:
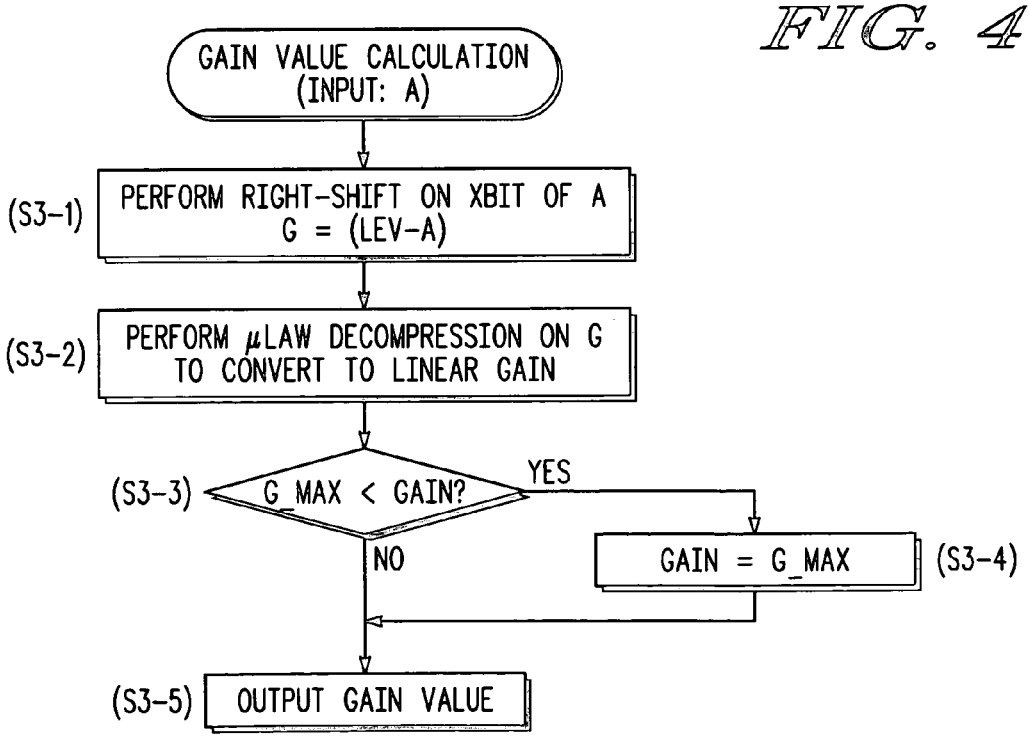
FIG. 4 is a flowchart showing a further process performed in the first embodiment.
Figure 5:
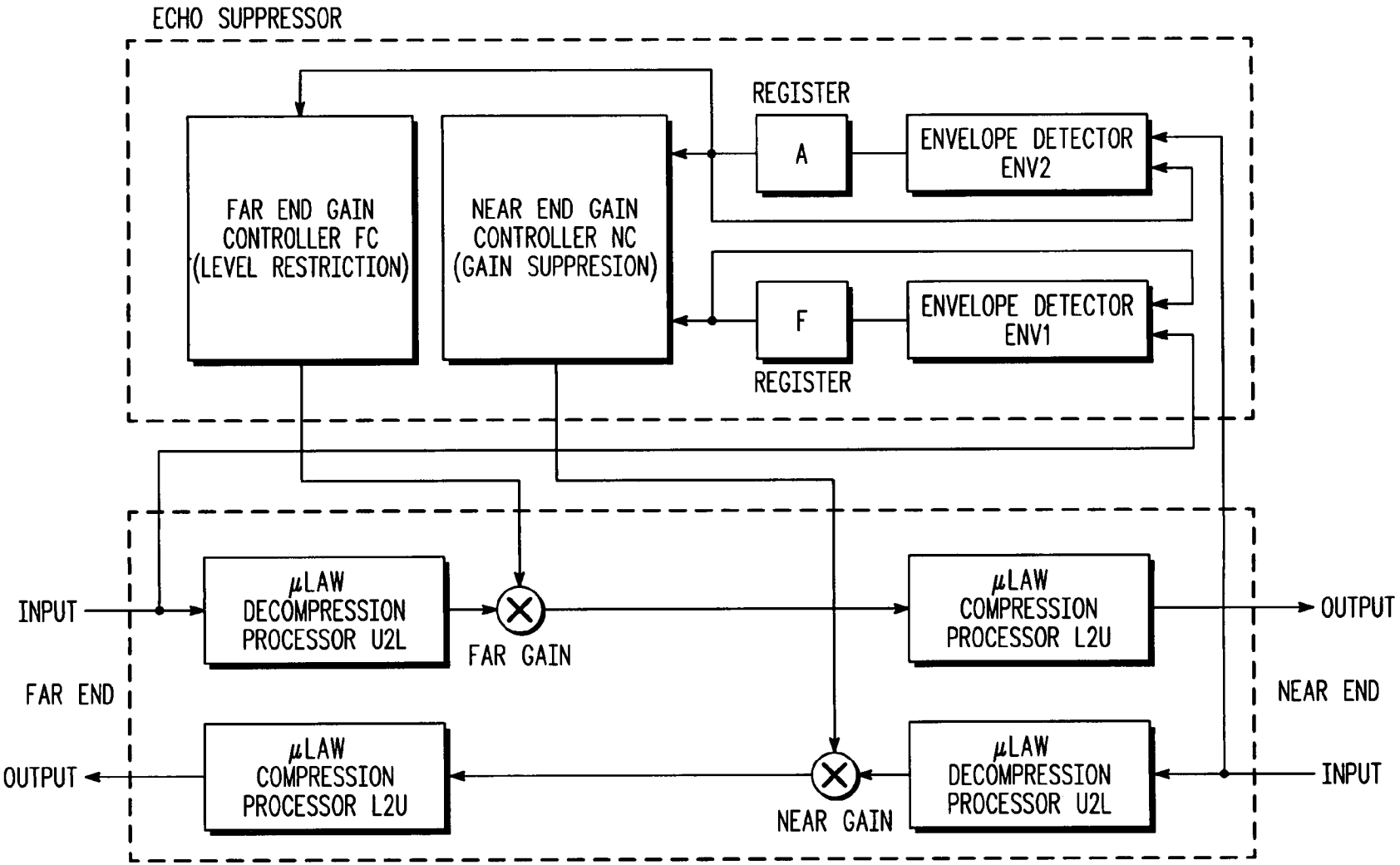
FIG. 5 is a block diagram showing an echo suppressor according to a second embodiment of the present invention.

Subsequently, the gain calculation processor GAIN performs a gain calculation process, which is shown in FIG. 4. More specifically, the gain calculation processor GAIN first calculates a logarithm gain value G (step S3-1). That is, the gain calculation processor GAIN shifts an X bit of the logarithm average value A to the right and restores the scale with the scaling factor X. The logarithm gain value G is then obtained by subtracting the logarithm average value A from the fixed value LEV for a desired outlet level value.

The gain calculation processor GAIN then converts the logarithm gain value G to a linear gain (step S3-2). More Specifically, the logarithm gain value G is introduced to the μ Law decompression processor U2L of the vocal device to acquire a linear gain gain.

Further, the gain calculation processor GAIN compares a predetermined maximum gain G_Max with the linear gain gain (step S3-3). If the linear gain gain is greater than the maximum gain G_MAX, the linear gain gain is set as the maximum gain G_MAX (step S3-4). The linear gain gain is then output (step S3-5). The linear gain gain is fed back with respect to an output of the μ Law decompression processor U2L. This restricts the linear gain gain to the maximum gain G_MAX.

Second Embodiment

An echo suppressor ES according to a second embodiment of the present invention will now be described with reference to FIGS. 5 to 8. Normally, an echo canceller is capable of completely canceling noise but has a complicated structure. The echo suppressor ES is one type of voice switch, which compares the volumes of two noises and reduces the volume of the other noise, and has a relatively simple structure.

The echo suppressor ES functions as an additional signal processing means and is used in a vocal device, which incorporates μ Law decompression processors U2L and μ Law compression processors L2U. Such a vocal device is used for bidirectional communication between a near end and a far end. A paired set of the μ Law decompression processors U2L and the μ Law compression processors L2U is provided for each of the near end and the far end. By using the μ Law decompression processors U2L and μ Law compression processors L2U, the echo suppressor ES adjusts the levels of signals from the near end and the far end. The echo suppressor ES includes logarithm envelope detectors (ENV1, ENV2), a near-end gain controller (NC), and a far-end gain controller (FC).

Envelope Process

First, the logarithm envelope detector ENV1 of the echo suppressor ES extracts a signal SFE from the far end input to the μ Law decompression processor U2L. The signal SFF is a μ Law compressed CODEC signal.

Figure 6:
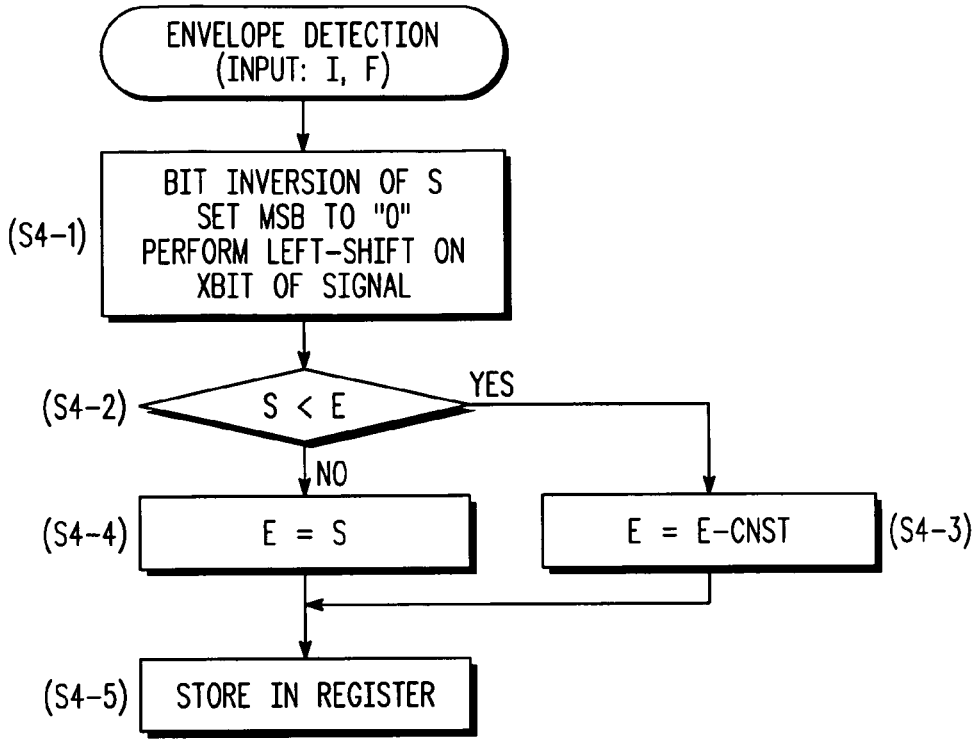
FIG. 6 is a flowchart showing a process performed in the second embodiment.

The logarithm envelope detector ENV1 executes a logarithm envelope detection process, which is shown in FIG. 6. More specifically, the logarithm envelope detector ENV1 performs an approximate logarithm conversion process (step S4-1). That is, the acquired signal SFE is subjected to bit inversion and the most significant bit (MSB) of the signal SFE is set to "0". This obtains an approximate μ log value. Further, in this step, scale enlargement is performed using the scaling factor X. In other words, an X bit of the signal SFE is shift toward the left.

The logarithm envelope detector ENV1 then reads a far-end envelope value EFE from a register F and compares the far-end envelope value EFE with the signal SFE (step S4-2). The register F functions as a far-end approximate peak value storage means. If the far-end envelope value EFE is greater than the signal SFE (YES in step S4-2), the constant CNST is subtracted from the far-end envelope value EFE to set a new far-end envelope value EFE (step S4-3). If the signal SFE is greater than or equal to the far-end envelope value EFE (NO in step S4-2), the signal SFE is set at the far-end envelope value EFE (step S4-4). Subsequently, the far-end envelope value EFE, which has been set in either step S4-3 or step S4-4, is stored in the register F (step S4-5). In this manner, a peak hold function is realized for the signal from the far end. That is, if an input value is less than a hold value, a fixed time constant value (CNST) is subtracted to realize attenuation characteristics.

A logarithm envelope AVE2 of the echo compressor ES also executes a logarithm envelope detection process similar to that shown in FIG. 6. In this case, a signal SNE is obtained from the near end input to the μ Law decompression processor U2L. Like the signal SFE, the signal SNE is μ Law compressed. A near-end envelope value ENE stored in a register N is compared with the signal SNE (step S4-2). The near-end envelope value ENE is then set (step S4-3 or step S4-4) and stored in the register N. The register N functions as a near-end approximate peak value storage means. This realizes the peak hold function for the signal of the near end and realizes attenuation characteristics.

Near-End Gain Control Process

Figure 7:
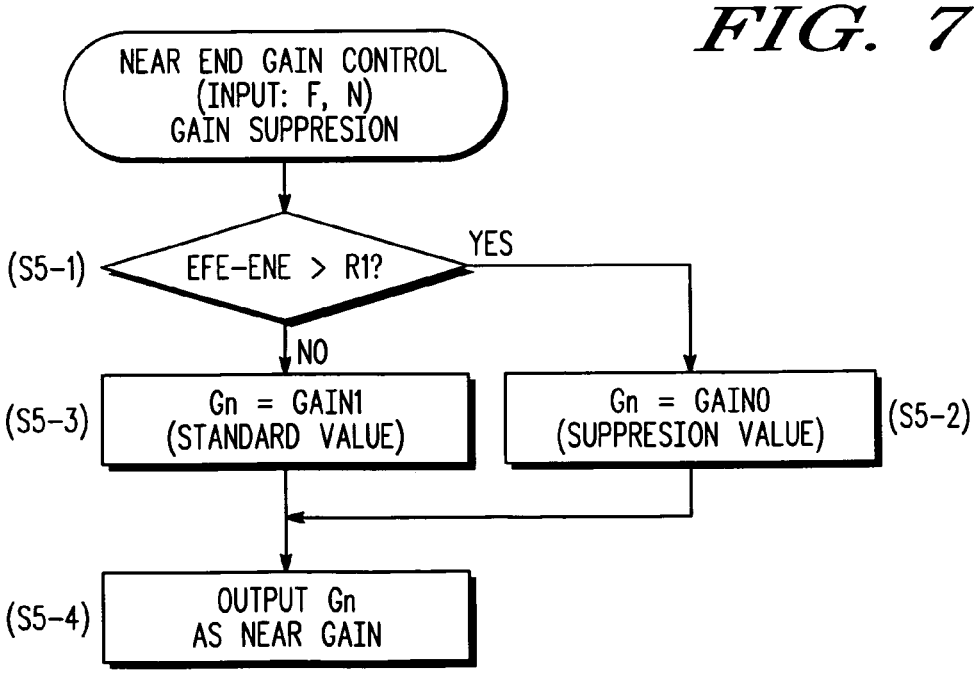
FIG. 7 is a flowchart showing a further process performed in the second embodiment.

The process performed by the near-end gain controller NC will be now be described with reference to FIG. 7.

In this process, the near-end envelope value ENE and the far-end envelope value EFE are used. More specifically, the near-end gain controller NC compares a constant R1 with the difference between the far-end envelope value EFE and the near-end envelope value ENE (step S5-1). If the constant R1 is less than the difference between the far-end envelope value EFE and the near-end envelope value ENE (YES in step S5-1), a suppression value GAINO is set as a near-end logarithm gain Gn (step S5-2). If the difference is less than or equal to the constant R1 (NO in step S5-1), a standard value GAIN 1 is set as the near-end gain Gn (step S5-3).

The near-end gain controller NC outputs the near-end gain Gn (step S5-4). The near-end gain Gn is fed back to the linear input of the near-end. In this embodiment, the near-end gain Gn multiplies the signal of the near end by an output processed by the μ Law decompression processor U2L.

Far-End Gain Control Process

Figure 8:
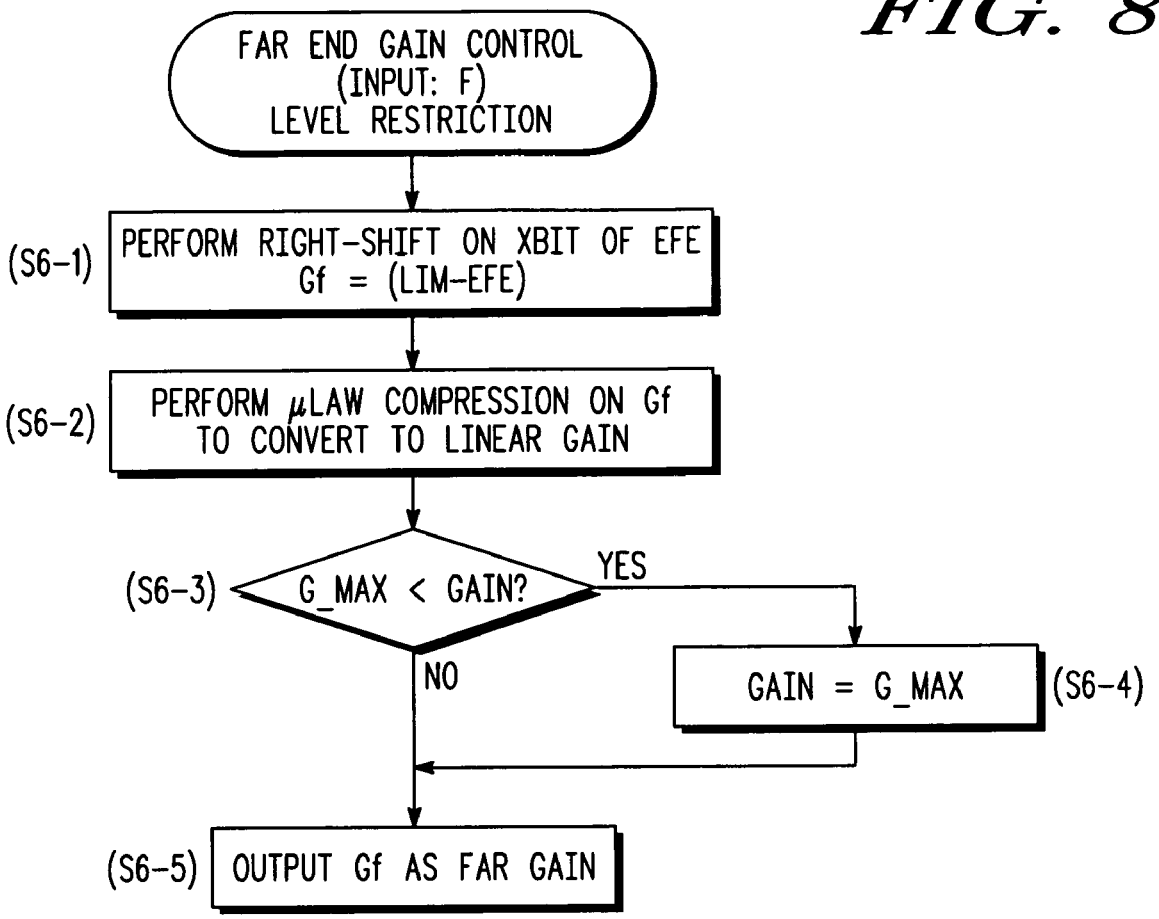
FIG. 8 is a flowchart showing another process performed in the second embodiment.

The process performed by the far-end gain controller FC will now be described with reference to FIG. 8.

First, the far-end gain controller FC shifts an X bit of the far-end envelope value EFE toward the right and restores the scale with the scaling factor X. For a desired output level value, a logarithm gain value Gf is calculated by subtracting the far-end envelope value EFE from a fixed value LIM (step S6-1). The fixed value LIM is stored in the far-end gain controller FC.

Subsequently, the far-end gain controller FC converts the logarithm gain value Gf to a linear gain as a linear conversion value (step S6-2). More specifically, the logarithm gain value Gf is introduced to the μ Law decompression processor U2L of the vocal device to acquire a linear gain gain.

The far-end gain controller FC then compares a maximum gain G_MAX, which is a predetermined maximum gain value, with the linear gain gain (step S6-3). If the linear gain gain is greater than the maximum gain G_MAX (YES in step S6-3), the linear gain gain is set as the maximum gain G_MAX (step S6-4).

The liner gain gain calculated in step S6-2 or step S6-4 is fed back (step S6-5). In this embodiment, an output of the μ Law decompression processor U2L generated by processing the signal of the far end is multiplied by the linear gain gain. This restricts the liner gain gain of the far end to the maximum gain G_MAX.

The illustrated embodiments have the advantages described below.

In the above embodiments, the μ Law compression value is converted to the approximate μ Law by using the μ Law decompression processor U2L and the μ Law compression processor L2U, which are incorporated in the vocal device.

In the logarithm area, multiplication is resolved into addition, and division is reduced into subtraction. Thus, power calculation may be performed by adding the same signals. The intensity ratio between two signals is calculated from the difference between the signals. In this manner, the power calculation or the signal ratio calculation may easily be performed using μ Law compressed signals. Accordingly, the number of commands is decreased by directly using the μ Law compressed signals without having to add a special logarithm conversion mechanism.

Further, complicated calculations including multiplication and division become unnecessary, and the execution of various signal processes is enabled in processors with relatively low capacities. Accordingly, the auto gain controller AGC and the echo suppressor ES operate efficiently. The codes used for processing in the linear area may be reduced by approximately one third to realize each function.

It should be apparent to those skilled in the art that the present invention may be embodied in many other specific forms without departing from the spirit or scope of the invention. Particularly, it should be understood that the present invention may be embodied in the following forms.

In the above embodiments, a device that is in compliance with the μ Law is described. However, the present invention may be applied to devices that comply with the A Law or other standards.

In the above embodiments, signal processing is performed using both of the μ Law decompression processor U2L and the μ Law compression processor L2U. However, as long as μ Law compressed signals can be obtained, one of these controllers may be eliminated.

The present examples and embodiments are to be considered as illustrative and not restrictive, and the invention is not to be limited to the details given herein, but may be modified within the scope and equivalence of the appended claims.

What is claimed is:

1. A voice signal processor for processing a voice signal, comprising:

signal conversion means for performing conversion between at least a logarithm compressed CODEC signal and a linear signal; and additional signal processing means for extracting the CODEC signal in a logarithm compressed state before the CODEC signal is input to the signal conversion means, processing the CODEC signal, and feeding back a signal processing result to a signal output from the signal conversion means, wherein the additional signal processing means includes:

means for calculating an approximate logarithm value by performing bit inversion on the extracted CODEC signal and setting a most significant bit to zero;

logarithm average storage means for storing a logarithm average value;

means for comparing the logarithm average value stored in the logarithm average storage means with the approximate logarithm value; and means for storing a value obtained by subtracting a predetermined value from the logarithm average value in the logarithm average storage means as a new logarithm average value when the approximate logarithm value is less than the logarithm average value and a value obtained by adding a predetermined value to the logarithm average value in the logarithm average storage means as a new logarithm average value when the approximate logarithm value is greater than the logarithm average value.

2. The voice signal processor according to claim 1, wherein:

the CODEC signal is a pulse code modulation signal.

3. The voice signal processor according to claim 1, wherein the additional signal processing means further includes:

means for calculating a linear conversion value obtained by converting the logarithm average value to a linear signal;

means for comparing a predetermined maximum gain value with the linear conversion value; and means to feed back the maximum gain value as a gain when the linear conversion value is greater than the maximum gain value and feed back the linear conversion value as the gain when the linear conversion value is less than the maximum gain value.

4. A voice signal processor for processing a voice signal, comprising:

signal conversion means for performing conversion between at least a logarithm compressed CODEC signal and a linear signal; and additional signal processing means for extracting the CODEC signal in a logarithm compressed state before the CODEC signal is input to the signal conversion means, processing the CODEC signal, and feeding back a signal processing result to a signal output from the signal conversion means, wherein the additional signal processing means includes:

means for calculating an approximate logarithm value by performing bit inversion on the extracted CODEC signal and setting a most significant bit to zero;

an approximate peak value storage means for storing an approximate peak value;

means for comparing the approximate peak value stored in the approximate peak value storage means with the approximate logarithm value; and means for storing a value obtained by subtracting a predetermined value from the approximate peak value in the approximate peak value storage means as a new approximate peak value when the approximate logarithm value is less than the approximate peak value and the approximate logarithm value in the approximate peak value storage means as a new approximate peak value when the approximate logarithm value is greater than the approximate peak value.

5. The voice signal processor according to claim 4, wherein the additional signal processing means further includes:

means for calculating the approximate peak values for a near end and a far end;

means to feed back a suppression value as a gain of the near end when the difference between the approximate peak value of the far end and the approximate peak value of the near end is greater than a predetermined value and feed back a standard value as the gain of the near end when the difference is greater than the predetermined value;

means for calculating a linear conversion value obtained by converting the approximate peak value of the far end to a linear signal; and means for comparing a predetermined maximum gain value with the linear conversion value; and means to feed back the maximum gain value as a gain of the far end when the linear conversion value is greater than the maximum gain value and feed back the linear conversion value as the gain of the far end when the linear conversion value is less than the maximum gain value.

* * * * *